US008079102B1

(12) United States Patent
Harris

(10) Patent No.: US 8,079,102 B1
(45) Date of Patent: Dec. 20, 2011

(54) TABLE APPARATUS FOR ADMINISTERING TO A RECALCITRANT PERSON

(76) Inventor: Wendell Neil Harris, Canyon, TX (US)

( * ) Notice: Subject to any disclaimer, the term of this patent is extended or adjusted under 35 U.S.C. 154(b) by 0 days.

(21) Appl. No.: 12/381,128

(22) Filed: Mar. 9, 2009

(51) Int. Cl.
*A47B 7/02* (2006.01)

(52) U.S. Cl. ..... 5/610; 5/600; 5/81.1 R

(58) Field of Classification Search ..... 5/81 R, 5/610, 83.1, 81.1, 81.1 R, 600, 81.1 RP, 930
See application file for complete search history.

(56) References Cited

U.S. PATENT DOCUMENTS

| | | | | | |
|---|---|---|---|---|---|
| 1,529,699 | A | * | 3/1925 | Hawk | 5/618 |
| 1,573,571 | A | * | 2/1926 | Pohl | 5/610 |
| 3,797,050 | A | * | 3/1974 | Benoit et al. | 5/610 |
| 3,805,080 | A | * | 4/1974 | Yager et al. | 5/610 |
| 3,997,926 | A | * | 12/1976 | England | 5/610 |
| 4,085,472 | A | | 4/1978 | DiMatteo | |
| 4,119,342 | A | | 10/1978 | Jones | |
| 4,285,541 | A | | 8/1981 | Onishi | |
| 4,504,988 | A | | 3/1985 | Deutchman | |
| 4,618,133 | A | * | 10/1986 | Siczek | 5/610 |
| 4,813,088 | A | | 3/1989 | DiMatteo et al. | |
| 5,001,789 | A | | 3/1991 | Schoenberger | |
| 5,275,175 | A | * | 1/1994 | Poirier et al. | 5/610 |
| 5,319,813 | A | | 6/1994 | DiMatteo et al. | |
| 5,864,901 | A | * | 2/1999 | Blumel | 5/610 |
| 5,899,132 | A | * | 5/1999 | Break et al. | 83/471.3 |
| 6,058,533 | A | * | 5/2000 | Nelson | 5/610 |
| 6,070,281 | A | * | 6/2000 | Reich | 5/610 |
| 6,112,349 | A | * | 9/2000 | Connolly | 5/610 |

* cited by examiner

*Primary Examiner* — Robert G Santos
*Assistant Examiner* — Brittany Wilson
(74) *Attorney, Agent, or Firm* — Norman B. Rainer

(57) ABSTRACT

A multifunctional table apparatus for administering to recalcitrant patients includes a rectangular table panel which can be easily pivoted from a vertical state containing the standing patient to a horizontal position which places the patient in a secured supine position. The pivoting motion is achieved by paired arcuate rocker legs associated with the front of the table and activated in cam-like manner by downward force applied to the rear of the table.

6 Claims, 4 Drawing Sheets

TABLE APPARATUS FOR ADMINISTERING TO A RECALCITRANT PERSON

BACKGROUND OF THE INVENTION

1. Field of the Invention

This invention concerns apparatus for administering health care and periodic hygienic maintenance to handicapped individuals, and more particularly relates to a table apparatus for receiving a patient from a standing position and restraining the patient in a supine position.

2. Description of the Prior Art

Children afflicted with Down Syndrome and/or Severe Autism or other neurological disorders often must be assisted with bathing, dressing and private toilet functions even at ages of ten years and older. Such inabilities of handicapped and health challenged persons cause significant problems for caregivers.

Once these children get older, to ten and above, their size and strength, often coupled with A.D.D. (attention deficit disorder) cause them to be highly unmanageable. The encounter between the caregiver and child becomes a struggle, especially when the youth is unwilling to cooperate.

Such episodes are strenuous for the caregiver. Not only are they physically exhausting, but they exact a toll on the caregiver's body, resulting in strained muscles, extended tendons, torn ligaments, and long-term chronic back and neck problems. The primary exertion required of the caregiver in such confrontations is lifting the youth onto a horizontal work surface from an initial sitting or standing position. Once the youth is placed in a supine position on a work surface, physical restraints must immediately be activated, often with difficulty, to maintain the youth in a serviceable position. Safety is always a primary concern, for both the caregiver and the youth, in order to keep the child from hurting himself and/or the caregiver. When a disturbed or frantic youth flails his arms about wildly, and kicks or bites, it is all too easy for injuries to occur. Similar problems are encountered with older patients afflicted with dementia or Alzheimer's disease. Numerous devices have earlier been disclosed for use in hospitals and other health care institutions for transferring a patient onto a horizontally oriented table from a sitting position, as in a wheelchair, or from a standing position. Most such devices require motorized equipment, and are space-consuming and expensive. There is further little accommodation for handling recalcitrant patients.

It is accordingly a primary object of the present invention to provide apparatus for transferring a standing patient onto the upper surface of a table caused to be horizontally oriented, said table being equipped with features for restraining said patient in a supine position.

It is another object of this invention to provide apparatus as in the foregoing object which can be folded to a compact storage state.

It is a still further object of the present invention to provide apparatus of the aforesaid nature amenable to easy portability.

It is yet another object of this invention to provide apparatus of the aforesaid nature which can be easily pivoted by hand manipulation to cause said table surface to move between vertical and horizontal orientation.

These objects and other objects and advantages of the invention will be apparent from the following description.

SUMMARY OF THE INVENTION

The above and other beneficial objects and advantages are accomplished in accordance with the present invention by a multifunctional table apparatus for transferring and restraining a recalcitrant patient comprising:

a) a table panel of substantially rectangular configuration elongated between front and rear edges having spaced apart corners, said panel further bounded by side edges and a flat upper surface, b) paired straight support legs of equal length associated with each rear corner in orthogonal relationship to said table panel, c) at least one cross bar extending laterally between said support legs, d) a pair of arcuate rocker legs downwardly directed from said front corners in parallel orientation and terminating in joinder with structural supports downwardly descendant from said opposed side edges, e) paired wheels mounted at said joinder sites and adapted to rotate in vertical planes upon horizontal axles, f) a rigid platform extending perpendicularly from said upper surface adjacent said front edge for supporting a patient, g) restraining belts of adjustable length extending between said side edges and adapted to cross over a patient lying upon said upper surface, and h) leg stirrup supports adjustably positioned above said upper surface adjacent said front edge.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
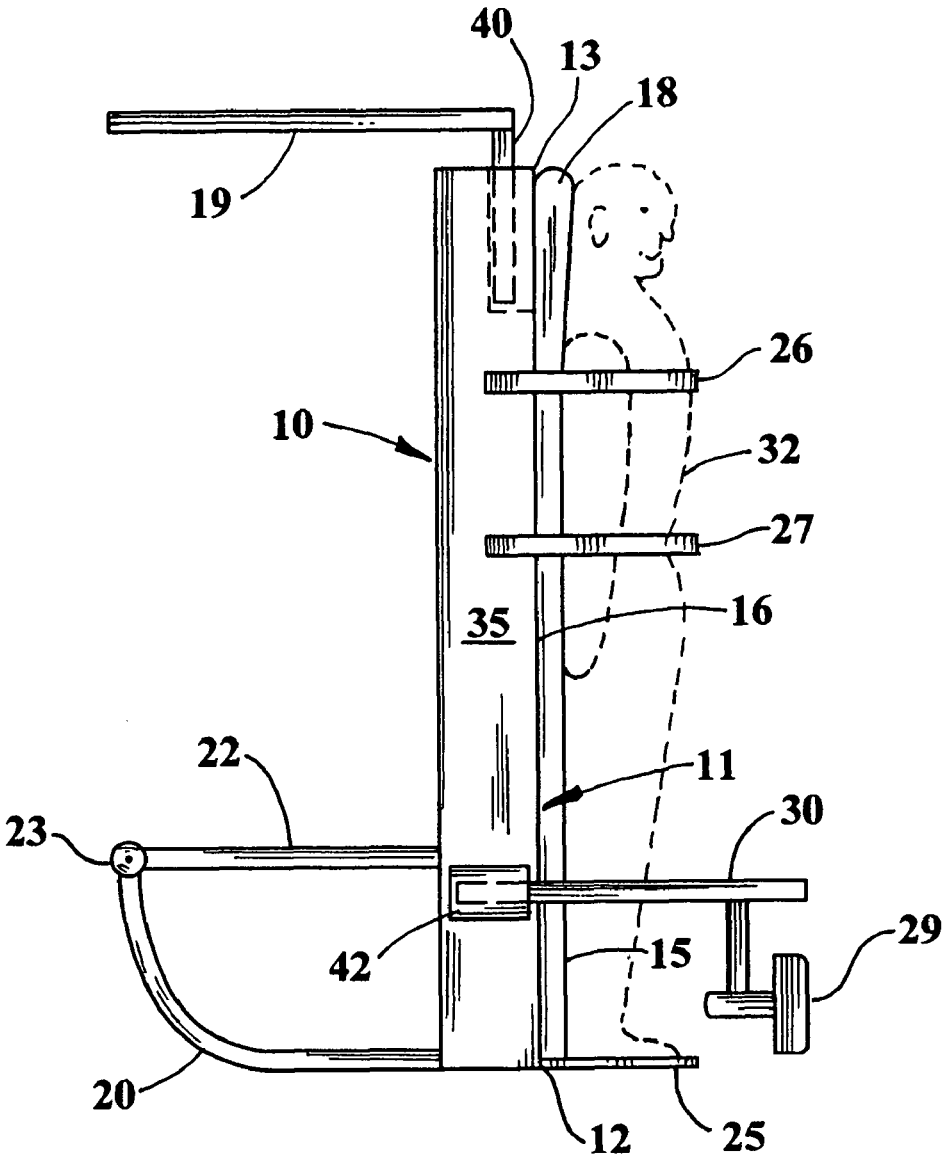
FIG. 1 is a side view of an embodiment of the table apparatus of the present invention showing in phantom outline a patient in standing position preparatory to being pivoted by the apparatus to a horizontal supine position.

Referring now to FIGS. 1-5, an embodiment of the table apparatus 10 of the present invention is shown comprised of table panel 11 of substantially rectangular configuration elongated between front and rear edges 12 and 13, respectively, having spaced apart corners 14, parallel side edges 15, and flat upper surface 16. A layer of padding 18 may be positioned upon upper surface 16. A rigid side panel 35 descends from each side edge 15.

Paired support legs 19 of equal length are associated with each rear corner and extend to orthogonally directed upper arms 40 which adjustably engage a corresponding side panel. At least one cross bar 41 extends in joinder between said legs in parallel relationship to said table panel.

A pair of arcuate rocker legs 20 are downwardly emergent from table panel 11 at said front corners in parallel orientation and convexly contoured with respect to said table panel. Said rocker legs terminate in rearwardly directed ends 21. Straight support members 22 extend perpendicularly from side panels 35 to joinder with said ends 21. At said joinder sites, wheels 23 are mounted upon horizontal axles for rotation in vertical planes to facilitate rolling movement of the table apparatus. Transverse structural means 43 laterally unite said rocker legs, and transverse beam 44 unites support members 22.

A rigid platform 25 extends upwardly from upper surface 16, and is slidably positionable along side panels 35 to accommodate standing or seated patients.

Upper securing belt means 26 extends between side panels 35 in adjustable engagement therewith, and is adapted to cross over the chest region of a patient 32 lying upon padding 18. Lower adjustable securing belt means 27 likewise extends between side panels 35, and is adapted to cross over the pelvic or thigh region of the patient.

Paired leg retaining stirrups 29 are associated with posts 30 that adjustably extend upwardly from securing collars 42 attached to side panels 35. When a patient is in substantially supine position upon padding 18, his or her legs are raised, bent at the knees and spread apart so that the ankles or lower leg portions rest upon said stirrups.

Figure 2:
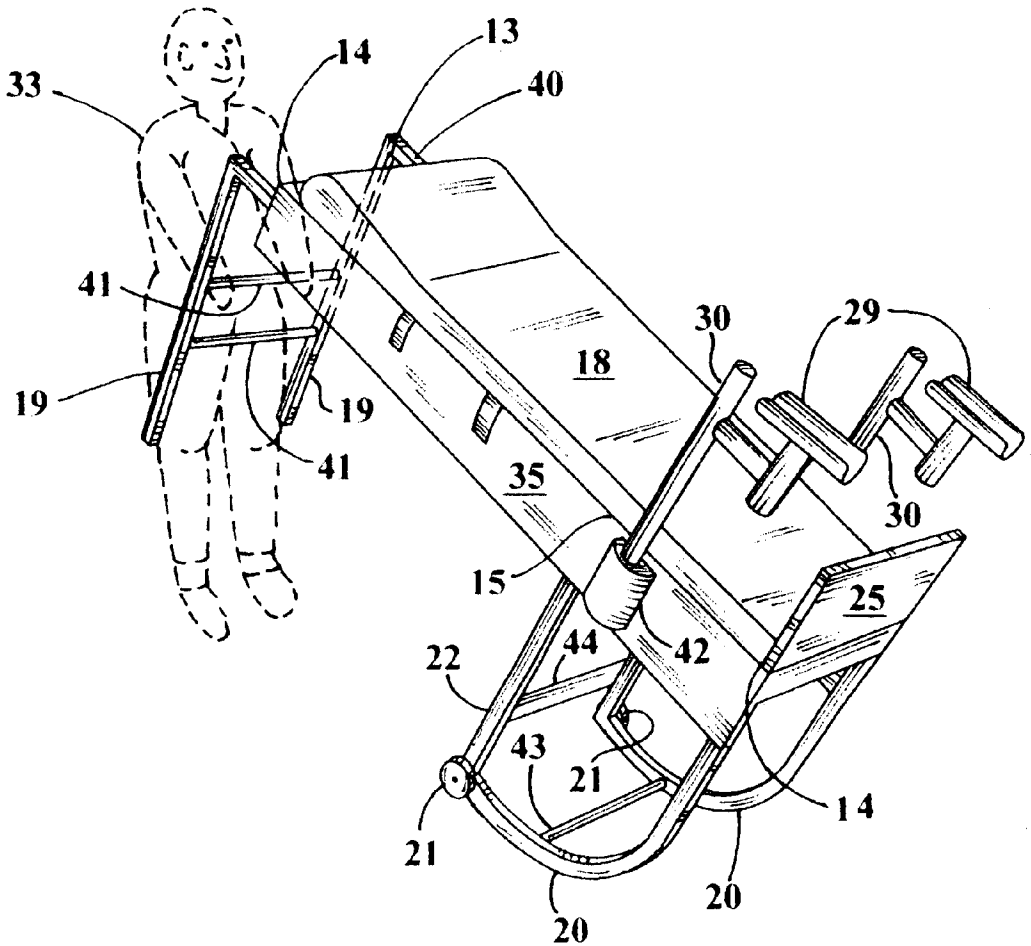
FIG. 2 is a perspective side view showing how the apparatus is manually tilted to lift the patient to a horizontal position.
Figure 3:
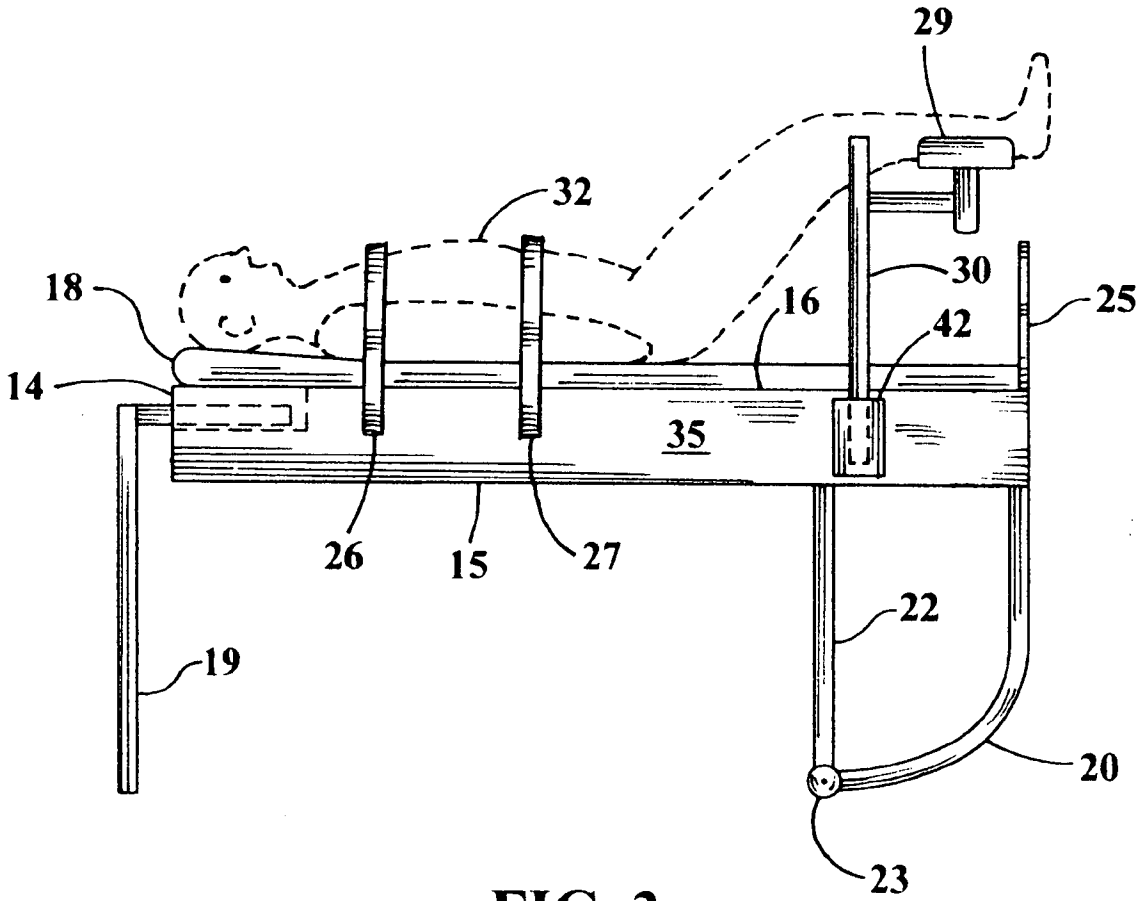
FIG. 3 is a side view of the embodiment of FIG. 1 shown in a state which horizontally supports a patient.
Figure 5:
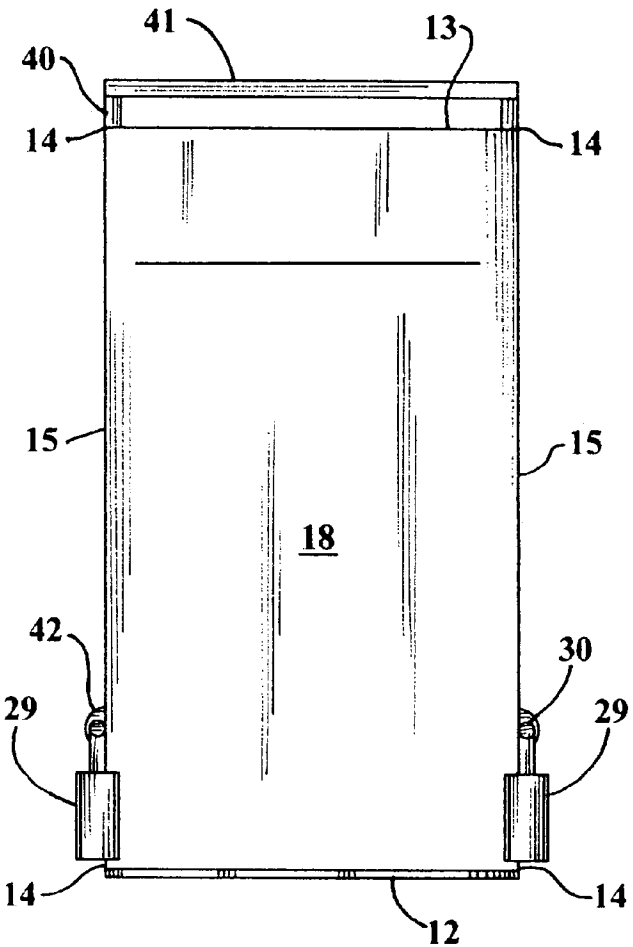
FIG. 5 is a front view of the embodiment of FIG. 1.
Figure 4:
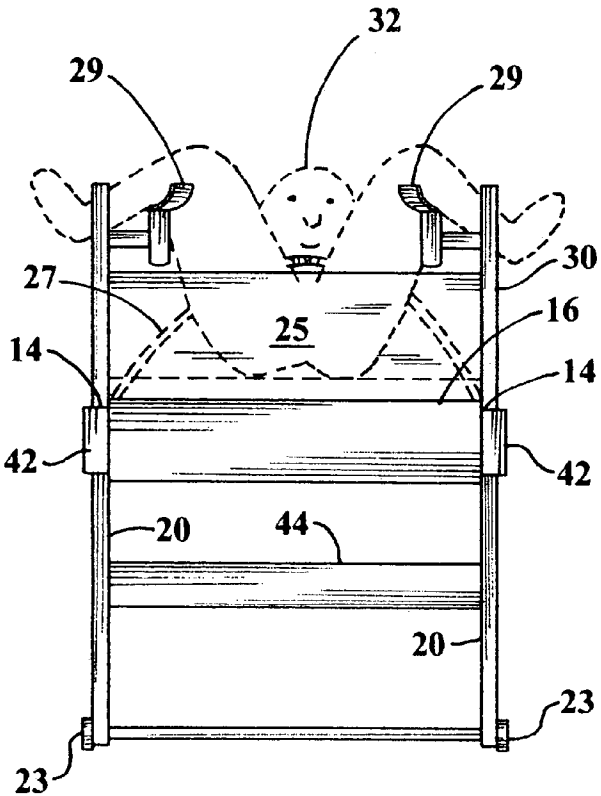
FIG. 4 is a front view of the embodiment of FIG. 3.

In operation, as best shown in FIGS. 1 and 2, the patient 32 is caused to stand upon step plate 25 with his or her back contacting padding 18 upon upper surface 16. The patient is then restrained by upper and lower securing belts 26 and 27, respectively. The caregiver person 33 then grasps a cross bar 41, and pulls downwardly. This causes rocker legs 20 to function as cams which easily enable the table to pivot from a vertical state to a horizontal state that facilitates servicing of the patient.

The various components of the table apparatus are fabricated of strong lightweight materials such as PVC tubing, structural plastics, and aluminum.

In preferred embodiments, the front and rear legs are designed to fold inwardly toward panel 11 to produce a storage state having a compact volume. Likewise, support members 30, stirrup assemblies 29, and platform 25 may be foldable or removable to further minimize the space requirements of the apparatus in its storage state.

By grasping a cross bar 41 and lifting slightly, the caregiver may cause the entire weight of the apparatus to rest upon wheels 23. In this condition, the apparatus can easily be transported to any location upon the flat floors of a building.

A wash basin may be recessed into table panel 11 to further facilitate the changing of a diaper and clean-up of the patient.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A multifunctional table apparatus for transferring and restraining a recalcitrant patient comprising:

a) a table panel of substantially rectangular configuration elongated between front and rear edges having spaced apart corners, said panel further bounded by side edges and a flat upper surface, b) paired straight support legs of equal length associated with each rear corner in orthogonal relationship to said table panel, c) at least one cross bar extending laterally between said support legs, d) a pair of arcuate rocker legs downwardly directed from said front corners in parallel orientation and terminating in joinder with structural supports downwardly descendant from said opposed side edges, thereby enabling said table panel to be rotated 90° from a vertical upright state to a horizontal state by application of downward force upon said cross bar, e) paired wheels mounted at said joinder sites and adapted to rotate in vertical planes upon horizontal axles, f) a rigid platform extending perpendicularly from said upper surface adjacent said front edge for supporting a patient, g) restraining belts of adjustable length extending between said side edges and adapted to cross over a patient lying upon said upper surface, and h) leg stirrup supports adjustably positioned above said upper surface adjacent said front, edge, whereby i) the table apparatus is configured to support and secure the patient in a supine position with legs raised, bent at the knees and spread apart so that the ankles or lower leg portions rest upon said leg stirrup supports.

2. The table apparatus of claim 1 further equipped with padding means disposed upon the upper surface of said table panel.

3. The table apparatus of claim 2 wherein said paired straight support legs extend to orthogonally directed upper arms which adjustably engage a corresponding side panel.

4. The table apparatus of claim 2 wherein said platform is slidably positionable along said side panels.

5. The table apparatus of claim 1 wherein said apparatus can be transported by rolling movement upon said wheels.

6. The table apparatus of claim 1 wherein a compact storage state is produced by foldable and removable features of said front and rear legs, stirrup supports and platform.

* * * * *